US008753161B1

(12) United States Patent
Van Denburgh, III

(10) Patent No.: US 8,753,161 B1
(45) Date of Patent: Jun. 17, 2014

(54) SNOWMAN KIT

(76) Inventor: John Burton Van Denburgh, III, Slingerlands, NY (US)

( * ) Notice: Subject to any disclaimer, the term of this patent is extended or adjusted under 35 U.S.C. 154(b) by 179 days.

(21) Appl. No.: 13/115,584

(22) Filed: May 25, 2011

(51) Int. Cl.
*A63H 33/00* (2006.01)
*A63H 33/32* (2006.01)

(52) U.S. Cl.
USPC ..... 446/73; 446/70

(58) Field of Classification Search
USPC ..... 446/70, 72–74; 249/117, 119–121, 126; 472/126
See application file for complete search history.

(56) References Cited

U.S. PATENT DOCUMENTS

| | | | | |
|---|---|---|---|---|
| 3,059,279 | A | 10/1962 | Rossi | |
| 3,841,019 | A | 10/1974 | Lorenzo | |
| 4,164,341 | A * | 8/1979 | McComb | 249/126 |
| 5,071,387 | A * | 12/1991 | Pottick | 446/475 |
| 5,632,926 | A | 5/1997 | Dyer, Jr. | |
| 5,851,415 | A | 12/1998 | Thomas | |
| 6,176,464 | B1 | 1/2001 | Harvey | |
| 7,000,887 | B1 | 2/2006 | Mulhern | |
| 7,264,531 | B2 * | 9/2007 | Asperas | 446/71 |

* cited by examiner

*Primary Examiner* — Kien Nguyen
(74) *Attorney, Agent, or Firm* — Maxine L. Barasch; Keohane & D'Alessandro PLLC

(57) ABSTRACT

A snowman kit and method of making a snowman is disclosed. In one embodiment, the kit comprises two legs, a base bowl, and a torso cap. The two legs form the base of the snowman. A torso formed from snow is placed in the base bowl. A torso cap of plastic is placed on the top of the torso. Plastic arms are attached to the torso cap, and a head is formed and placed on the torso cap.

15 Claims, 15 Drawing Sheets

SNOWMAN KIT

FIELD OF THE INVENTION

The present invention relates to a snowman kit and method of making a snowman.

BACKGROUND

A snowman is typically constructed by rolling snow into balls of various sizes and then stacking the balls on top of one another. Constructing a large or well-formed snowman is difficult for children because of the strength and coordination required to form, lift, and stack the awkward balls of snow. Snowmen also all tend to have a similar look with the largest ball as the base, and progressively smaller balls at higher levels. It is therefore desirable to have an improved snowman kit for constructing a well-formed and unique-looking snowman.

SUMMARY

Embodiments of the present invention provide users with the unique ability to construct a snowman with lifelike features. Specifically the key features are arms and legs. This is accomplished through the convergence of molded plastic components and sculpted snow. All components after assembly are secured by ballast and surface friction of the snow. The components may be made from plastic or any other suitable material, and may, without limitation, be "milky white" in color and semi-transparent to resemble the appearance of natural snow.

In one embodiment, the lower section comprises three main parts. The sections are: left leg, right leg, and base bowl. In one embodiment, there is a lip located at the top of each leg. The legs support the base bowl like pedestals. During assembly, a user fills the legs with snow to create a stable foundation to support the base bowl. The feet of the legs may be open. This design feature will provide support and water drainage from snow melt. To build a snowman, the legs should be forced into the snow on the ground allowing snow to fill the legs. The users then will continue to fill and pack the legs with snow. The legs may be filled with snow before the base bowl is placed upon the legs. The snow inside the legs provides additional support and stabilization. The holes on the base bowl will fit over the lips on the top of each leg. The legs should be completely filled after the base bowl is secured. Then additional snow should be placed into the base bowl to completely cover the exposed lips of the legs.

To construct the body of the snowman, a snowball is rolled until it is the desired size and placed onto the base section. After the placement of the snow body, the user may sculpt the snow body by hand and form a sphere or other suitable shape.

An alternate design for the base section comprises two parts. These sections are assembled by the use of fasteners. The fasteners fasten together to assemble the base bowl. This embodiment allows for more compact storage and shipping.

The feet of the base section may be open, exposing the ground on which the snowman is built upon. This design feature provides both support and water drainage from snow melt.

The torso cap section may comprise ridges on each side to attach the arms. The arms should be attached at the very end of assembly. The torso cap section is placed on the top portion of the snow body. Then, excess snow is removed at the open end of the torso cap section (where the head will be positioned). The removal of snow creates a concaved cradle for the positioning of the head.

After the placement of the head, the user may further sculpt the head by hand and form a sphere. Close attention should be placed on the symmetrical balance of the head.

Arms are slid into place and secured to the torso cast section. The finger/thumb tips are designed open to allow for drainage.

An alternate embodiment comprises a base bowl of two sections. In one embodiment, these sections are assembled by the use of six hinges. The hinges are pinned together by three lengths of semi-flexible rods. The hinges are strategically located on the "base bowl" (one on each side) and on the outer and inner portions of the legs (six hinges in total). The three semi-flexible rods are used to sleeve the hinges. One semi-flexible rod per side will pin the "base bowl" hinge and the outer leg hinge. The second semi-flexible rod will pin the opposite side, "base bowl" hinge and outer leg hinge. The third semi-flexible rod will sleeve both inner leg hinges. Alternatively, a fastener system with tabs and corresponding receptacles may be used to join the two parts of the base bowl.

Embodiments of the present invention enhance snowman creating and outdoor winter activities. The resulting snowman is more lifelike and allows for a greater sense of wonder for its creators.

In one embodiment, a snowman kit is provided. The snow man kit comprising:

a base bowl;

a plurality of hollow leg structures affixed to the base bowl; and a foot structure affixed to the bottom of each leg structure.

In another embodiment, a method of making a snowman is provided, comprising:

filling a plurality of hollow leg structures with snow;

installing a base bowl on top of the plurality of hollow leg structures; and forming a torso of snow, wherein the bottom of the torso is disposed within the base bowl.

DETAILED DESCRIPTION

Figure 1:
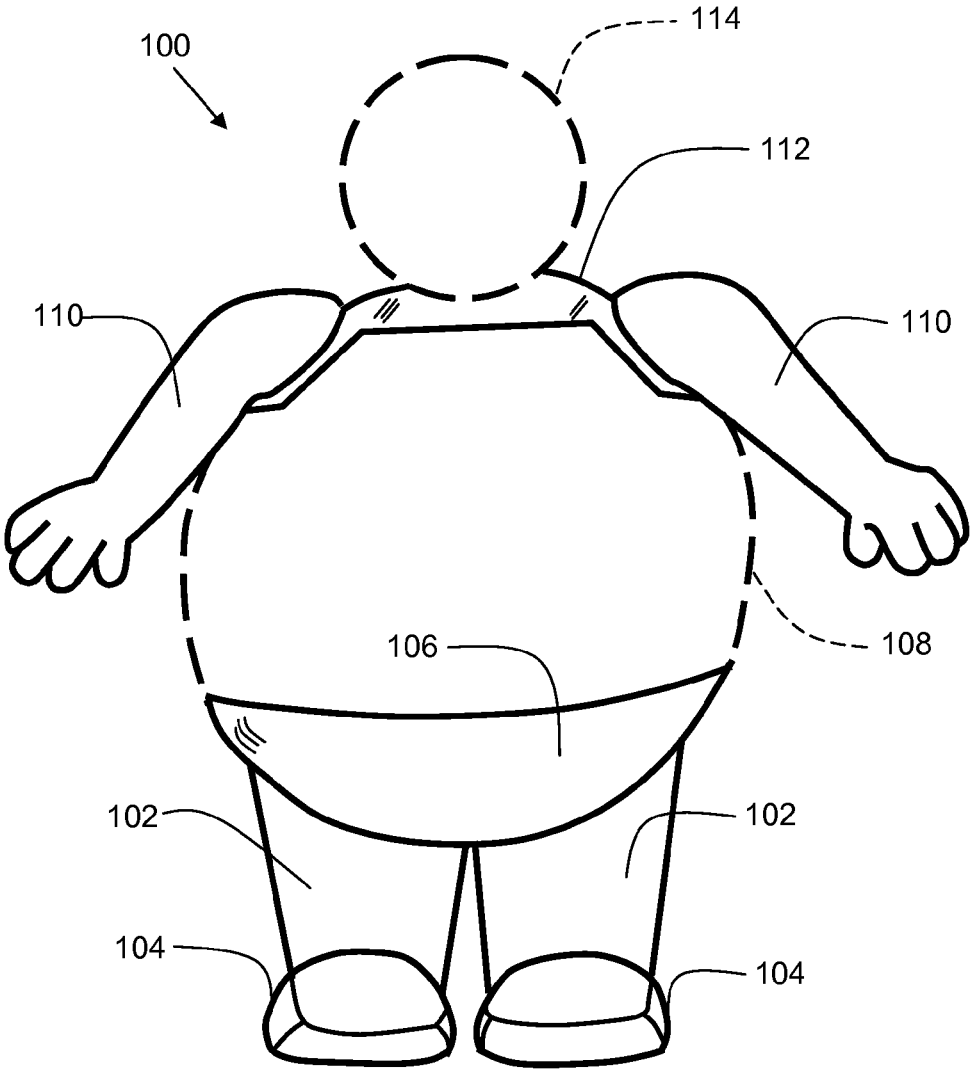
FIG. 1 shows a front view of an embodiment of the present invention.
Figure 2:
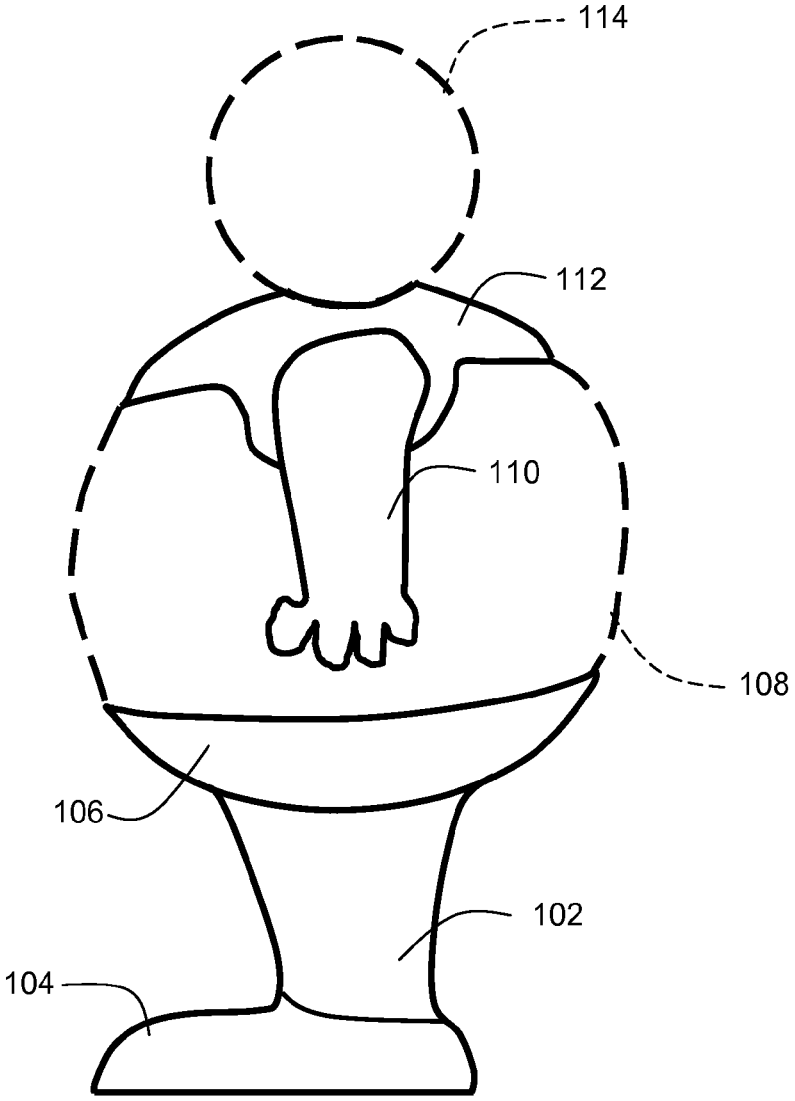
FIG. 2 shows a side view of an embodiment of the present invention.

FIG. 1 shows a front view of a snowman 100 built using a snowman kit in accordance with an embodiment of the present invention. FIG. 2 shows a side view the embodiment of FIG. 1. Legs 102 are affixed to base bowl 106 at the top of legs 102. At the bottom of each leg 102, a foot 104 is affixed. In one embodiment, foot 104 has no sole, which allows melting snow to drain out of the legs 102.

The legs 102 may attach to the base bowl 106 via, without limitation, a friction fit. The legs 102 are preferably hollow. During assembly of a snowman, the legs are attached to the base bowl. The hollow legs are then filled with snow, thereby acting as pedestals to provide stability. A torso 108 is then formed with additional snow, with the lower portion of torso 108 residing within base bowl 106. A torso cap 112 is then placed on torso 108. In some embodiments, arms 110 are affixed to the torso cap 112. In other embodiments, arms 110 may be affixed directly to torso 108. The arms 110 may be comprised of plastic, and may be hollow as to reduce weight while still being sturdy. A head 114 is formed with snow and placed on top of torso cap 112. The snowman 100 may then be accessorized according to preference, with hats, eyes, and the like.

Figure 2A:
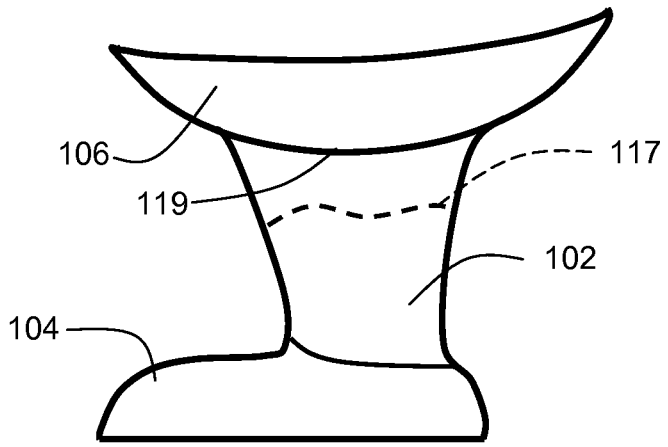
FIG. 2A shows a side view of the legs and base bowl in a partially snow-filled condition.

FIG. 2A shows a side view of the legs 102 and base bowl 106 indicating a partially snow-filled condition. In this view, the snow 117 is partially filling legs 102. To assemble the snowman, snow may be filled to the level of the bottom 119 of base bowl 106 to provide additional weight and stability for the snowman.

Figure 2B:
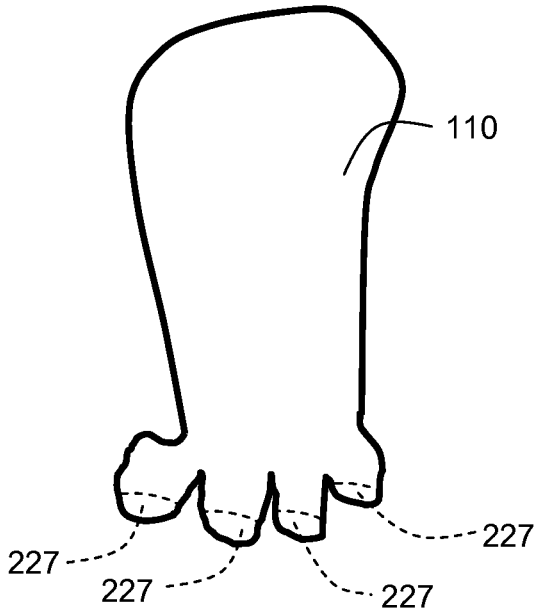
FIG. 2B shows an alternative embodiment of an arm.

FIG. 2B shows an alternative embodiment of an arm 110. In this embodiment, each finger and thumb have an opening 227 at the fingertip to allow drainage of any water that may enter the hollow cavity of arm 110.

Figure 3:
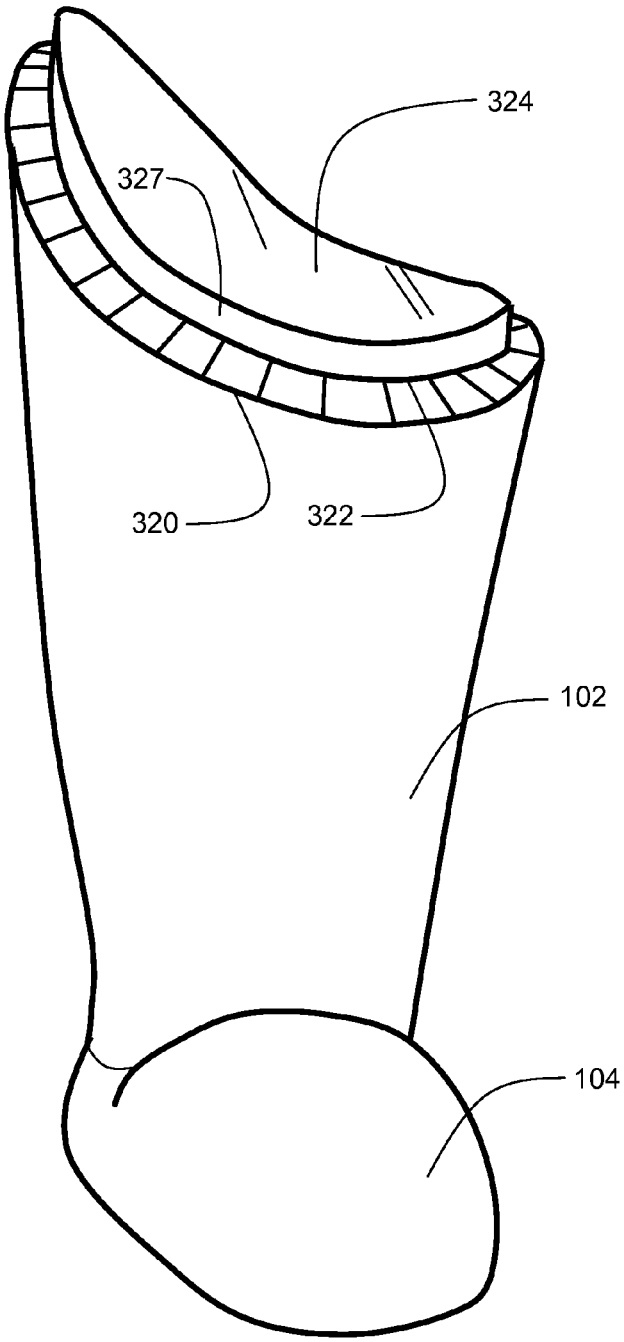
FIG. 3 shows a detailed view of a leg and foot.

FIG. 3 shows a detailed view of a leg 102 and foot 104. Foot 104 preferably has no sole, or may have a sole with drainage holes within it, to allow drainage of melting snow. Leg 102 is preferably hollow, and has cavity 324 where a user can pack snow into leg 102. Leg 102 may have outer wall 320 and inner wall 322. The inner wall 322 may be slightly taller than outer wall 320 as to form lip 327 which may be inserted into base bowl 106 (FIG. 1) via a friction fit.

Figure 4:
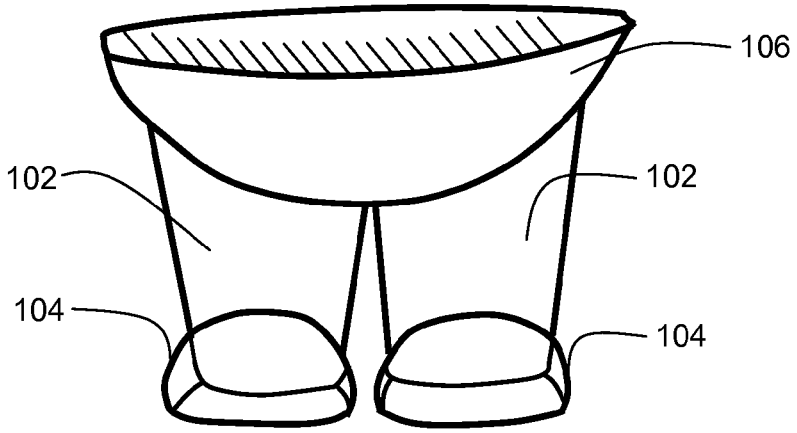
FIG. 4 shows a front perspective view of the legs and base bowl.

FIG. 4 shows a front perspective view of the legs 102, feet 104, and base bowl 106. To form a snowman, a torso of snow is formed, with the bottom portion of the torso residing in base bowl 106.

Figure 5:
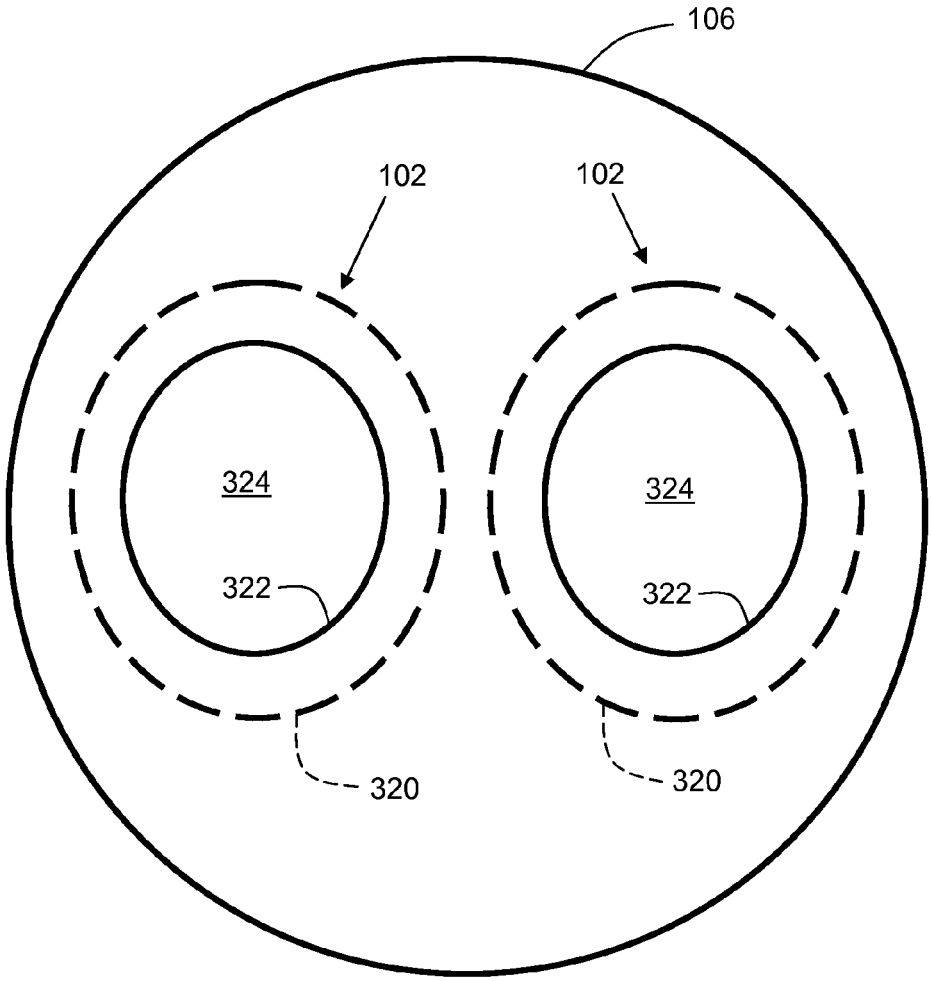
FIG. 5 shows a top-down view of the legs and base bowl.

FIG. 5 shows a top-down view of the base bowl 106 and legs 102. Inner wall 322 of legs 102 extends into base bowl 106 whereas outer wall 320 contacts the bottom of base bowl 106 and serves to support the base bowl 106. Legs 102 are hollow and have cavity 324 formed within inner wall 322. During assembly of a snowman, snow is packed into the cavities 324 to provide weight and stability for the snowman.

Figure 6:
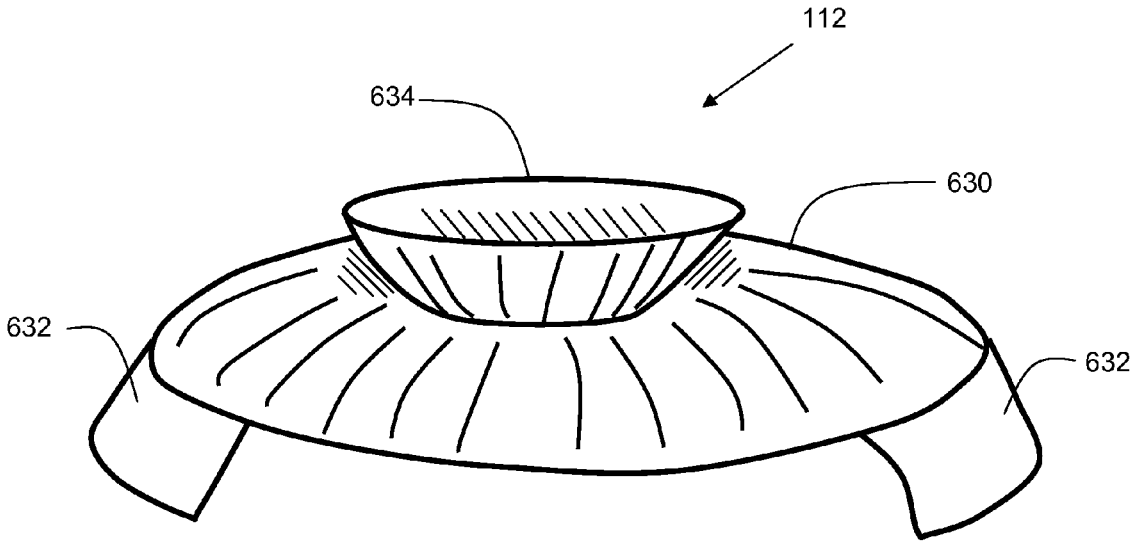
FIG. 6 shows a front view of a torso cap.

FIG. 6 shows a front view of a torso cap 112. Torso cap 112 is placed upon torso 108 (FIG. 1) during assembly. Torso cap 112 comprises collar 630 and shoulder plates 632. Torso cap 112 may further comprise neck bowl 634 which provides support for a head 114 (FIG. 1) which is comprised of snow.

Figure 7:
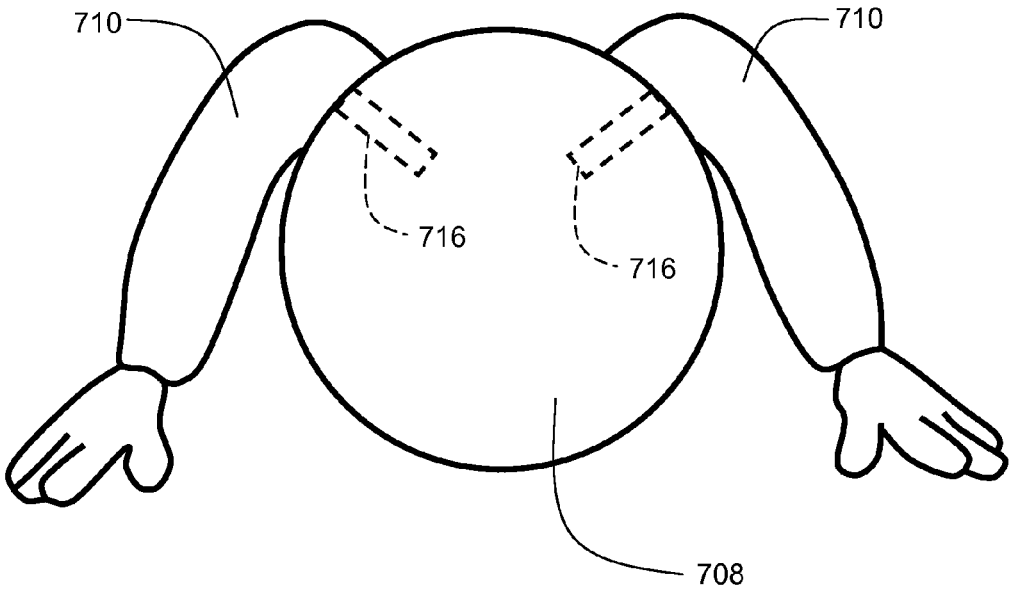
FIG. 7 shows an embodiment of an arm.

FIG. 7 shows an embodiment of an arm 710 which is installed directly into the torso 708. Torso 708 is comprised of snow. Arms 710 may be comprised of plastic and have stake 716 which is inserted into the torso to secure the arms 710 in place.

Figure 8:
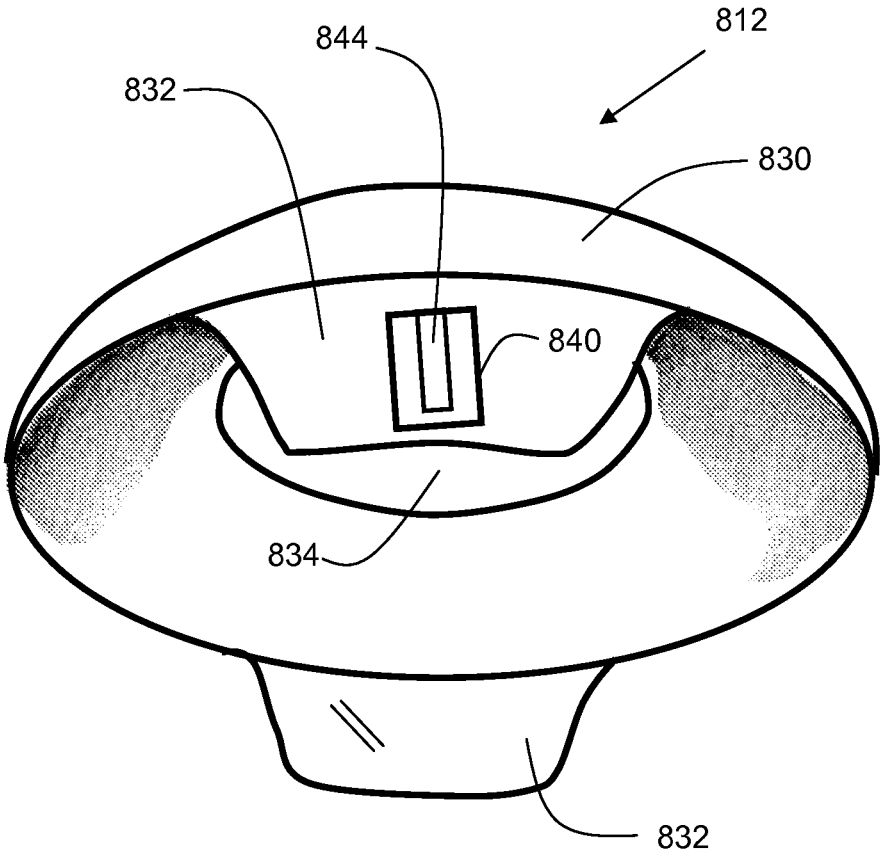
FIG. 8 shows a side perspective view of an alternate embodiment of a torso cap.
Figure 9:
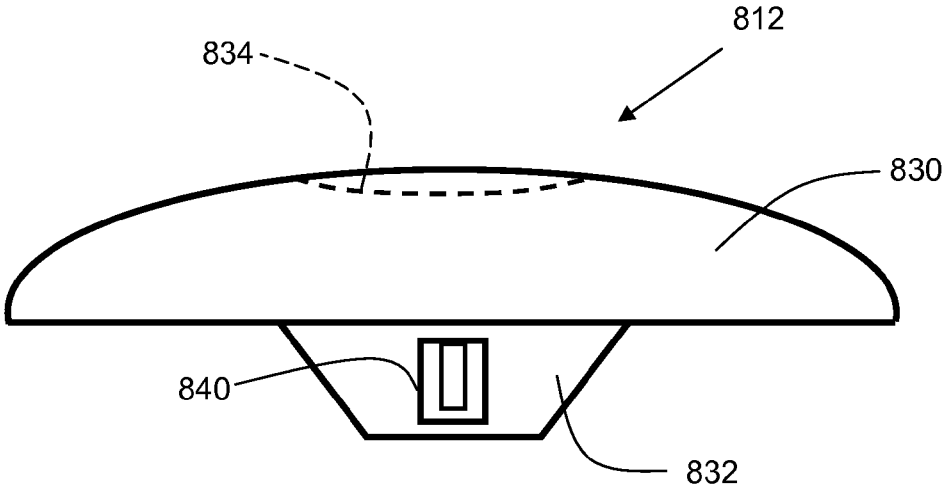
FIG. 9 shows a side view of the embodiment of FIG. 8.

FIG. 8 shows a side perspective view of an alternate embodiment of a torso cap 812. This view is from a position slightly below the torso cap 812, such that the underside is visible. Torso cap 812 comprises collar 830 and shoulder plates 832. Each shoulder plate 832 has an arm mount 840 affixed to it. In one embodiment, arm mount 840 comprises a ridge 844 that interlocks with a corresponding groove on the arm. Opening 834 exposes snow at the top of the torso such that a head formed from snow may be attached to the torso. Optionally, a neck bowl (such as 634 of FIG. 6) may be used to further stabilize the head. FIG. 9 shows a side view of the embodiment of FIG. 8.

Figure 10:
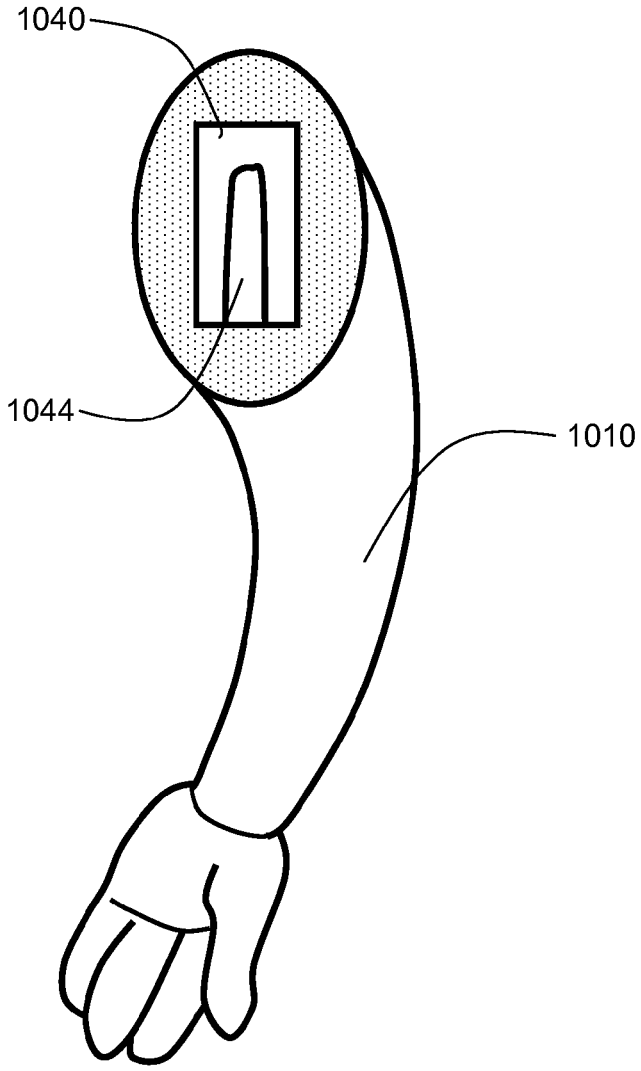
FIG. 10 shows an alternative embodiment of an arm.

FIG. 10 shows an alternative embodiment of an arm 1010 that fastens to the torso cap 812 shown in FIGS. 8 and 9. Arm 1010 comprises mount 1040 with groove 1044 adapted to receive ridge 844 of arm mount 840 (see FIG. 8 and/or FIG. 9) to secure arm 1010 to torso cap 812 (FIG. 8).

Figure 11:
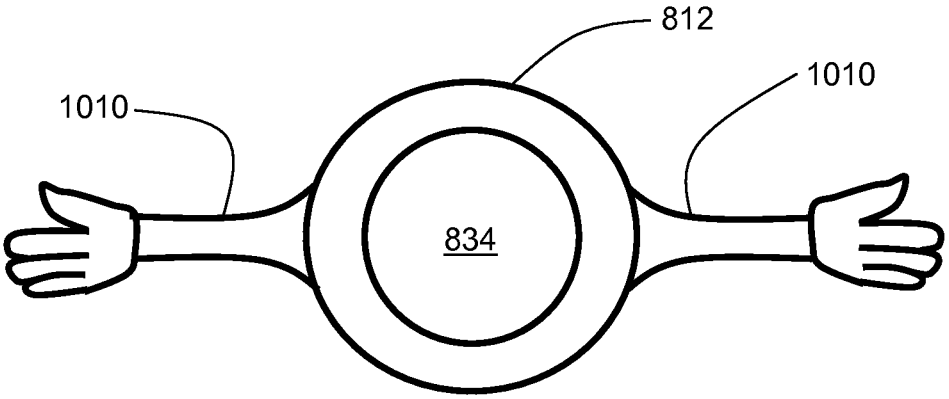
FIG. 11 shows a top-down view of a torso cap with arms.

FIG. 11 shows a top-down view of torso cap 812 with arms 1010 attached thereto. A head comprised of snow may be positioned over opening 834 in torso cap 812.

Figure 12:
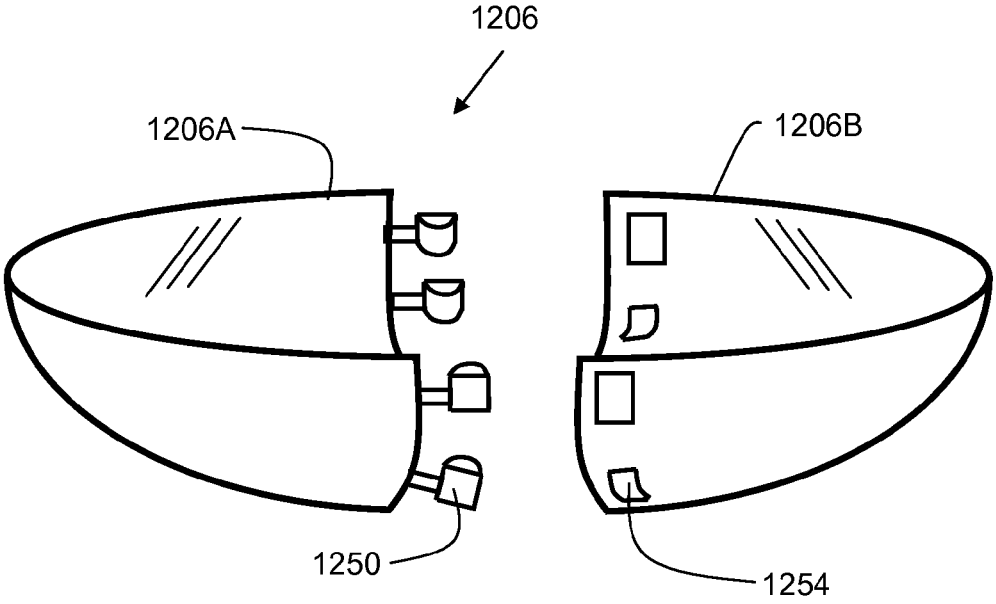
FIG. 12 shows an alternative embodiment of a base bowl.

FIG. 12 shows an alternative embodiment of a base bowl 1206. Base bowl 1206 is comprised of first part 1206A and second part 1206B. Parts 1206A and 1206B can be separated for shipping or storing. Part 1206A has a plurality of tabs (shown generally as 1250). Part 1206B has a plurality of receptacles (shown generally as 1254). For use, the tabs 1250 are inserted into corresponding receptacles 1254 to join parts 1206A and 1206B to form base bowl 1206. It will be recognized that any type of fasteners may be used in combination with or instead of tabs and receptacles for attaching base bowl pieces 1206A and 1206B. The invention is not limited to tabs and receptacles, and includes any feasible fasteners known to those of skill in the art.

Figure 13:
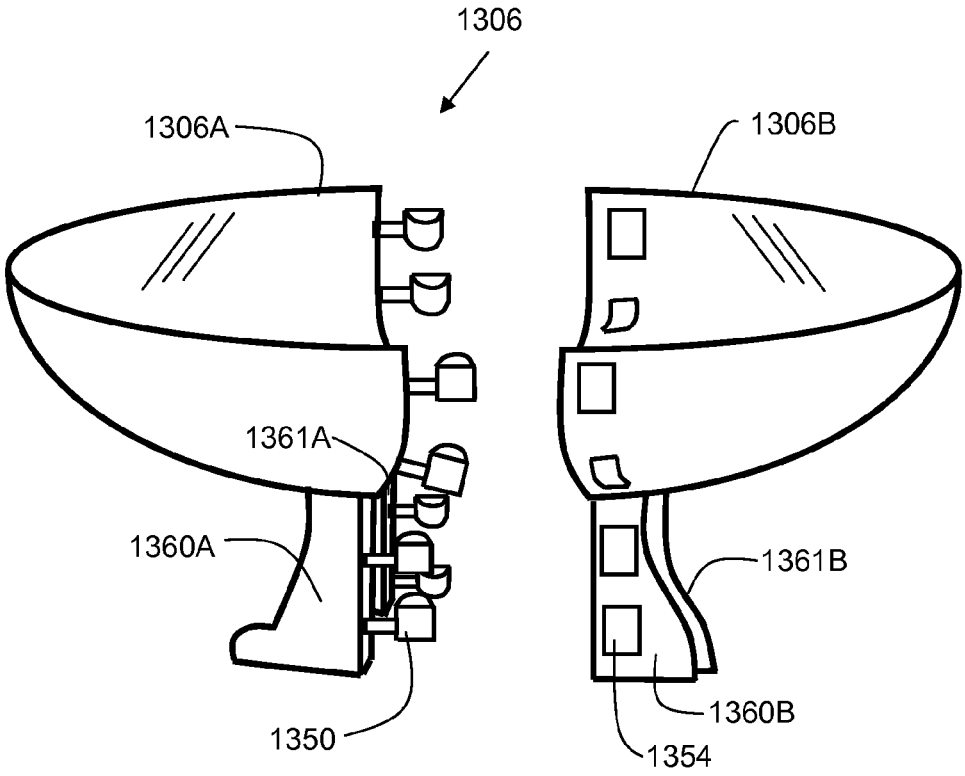
FIG. 13 shows an alternative embodiment of a base bowl with a pedestal.

FIG. 13 shows an alternative embodiment of a base bowl with pedestals. Similar to base bowl 1206 of FIG. 12, base bowl 1306 is comprised of first part 1306A and second part 1306B. Parts 1306A and 1306B can be separated for shipping or storing. Parts 1306A and 1306B further comprise complementary pedestal portions 1360A and 1360B to form a hollow leg and foot structure (similar to a leg and foot 102 and 104, respectively, of FIG. 1) when attached to one another as described below, and similar complementary portions 1361A and 1361B to form a second hollow leg and foot structure (similar to a leg and foot 102 and 104 respectively, of FIG. 1) again when attached to one another. It will be recognized that in some embodiments, the invention includes more or fewer complementary pedestal portions. Similar to the tabs and receptacles on the base bowl, the pedestal portions 1360A and 1361A have a plurality of tabs (shown generally as 1350). The pedestal portions 1360B and 1361B have a plurality of receptacles (shown generally as 1354). The base bowl 1306, when assembled, has integrated pedestals formed by snow-filled cavities (each similar to cavity 324 of FIG. 3) within the legs created by pedestal portions 1360A and 1361A and pedestal portions 1360B and 1361B. It will be recognized that any type of fasteners may be used in combination with or instead of tabs and receptacles for attaching base bowl pieces 1306A and 1306B and/or pedestal portions 1360A and 1360B and pedestal portions 1361A and 1361B. The invention is not limited to tabs and receptacles, and includes any feasible fasteners known to those of skill in the art.

Figure 14:
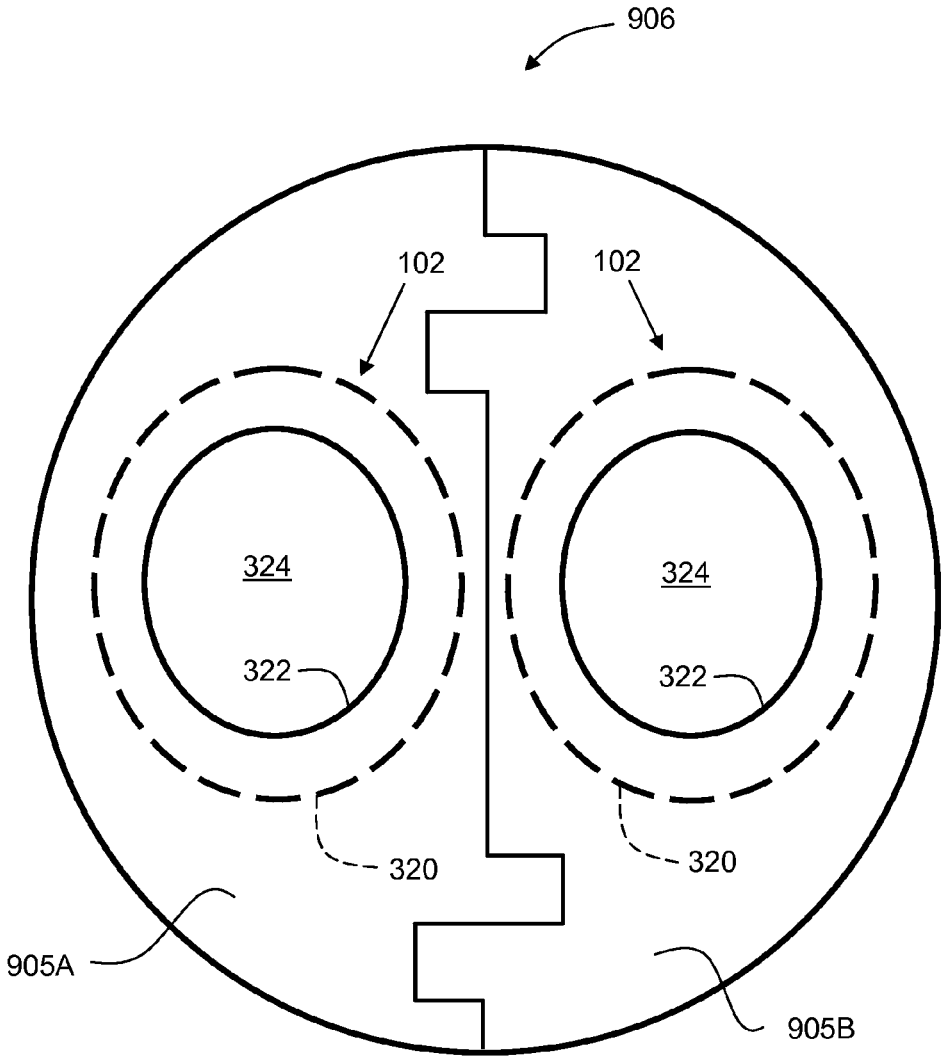
FIG. 14 shows a top-down view of an alternative embodiment of a base bowl.

FIG. 14 shows a top-down view of an alternative embodiment of a base bowl 906. Functionally, base bowl 906 is similar to the base bowl 106 of FIG. 5. The main difference being that base bowl 906 is comprised of two interlocking detachable parts shown as 905A and 905B. This allows the base bowl 906 to be shipped in two parts to allow for a smaller shipping container.

The various components of the snowman kit, such as legs, base bowl, torso cap, and arms, may be comprised of a sturdy plastic, such as polyethylene. The plastic may, without limitation, be molded and colored in a "milky" white color to resemble natural snow. While the preferred embodiment of this invention has been shown and described, it will be apparent to those skilled in the art that changes and modifications may be made therein without departing from the spirit of the invention, the scope of which is defined by the appended claims.

What is claimed is:

1. A snowman kit comprising:

a base bowl comprising a substantially bowl-shaped structure, wherein an interior of the structure defines a cavity configured to receive a bottom portion of a snowball while leaving an upper portion of the snowball exposed above the structure;

a plurality of hollow leg structures affixed to the base bowl, the plurality of hollow leg structures configured to receive snow packed therein; and a foot structure affixed to each leg structure.

2. The snowman kit of claim 1, wherein the plurality of hollow leg structures comprises two leg structures.

3. The snowman kit of claim 1, wherein the base bowl and plurality of hollow leg structures are comprises of plastic.

4. The snowman kit of claim 1, further comprising a plurality of arms.

5. The snowman kit of claim 4, wherein the plurality of arms comprises two arms.

6. The snowman kit of claim 5, wherein each of the plurality of arms comprises a first end and a second end, and a stake affixed to the arm at the second end.

7. The snowman kit of claim 4, wherein each arm comprises a fingertip opening configured and disposed to allow drainage of water in each arm.

8. The snowman kit of claim 1, further comprising a torso cap configured to rest upon the upper portion of the snowball.

9. The snowman kit of claim 8, wherein the torso cap further comprises a plurality of arm mounts.

10. The snowman kit of claim 9, wherein each of the plurality of arm mounts comprises a ridge, and wherein each of the plurality of arms comprises a first end and a second end, and a corresponding groove affixed to the second end, wherein the corresponding groove is configured and disposed to engage the ridge of one of the plurality of arm mounts.

11. The snowman kit of claim 8, wherein the torso cap further comprises a neck bowl.

12. The snowman kit of claim 1, wherein the structure of the base bowl comprises a first part and a second part, wherein the first part and second part each have complementary fasteners.

13. The snowman kit of claim 12, wherein the fasteners on the first part comprise tabs extending outward from the first part, and wherein the fasteners on the second part comprise receptacles configured and disposed to receive the tabs when the first part is attached to the second part.

14. A snowman kit comprising:

a base bowl comprising a substantially bowl-shaped structure, wherein an interior of the structure defines a cavity configured to receive a bottom portion of a snowball while leaving an upper portion of the snowball exposed above the structure, the bowl-shaped structure comprising a first part and a second part, wherein the first part and second part each have complementary fasteners;

a first pedestal portion attached to the first part;

a second pedestal portion attached to the second part;

wherein the first pedestal portion and the second pedestal portion each have complementary fasteners.

15. The snowman kit of claim 14, wherein the fasteners on the first part and first pedestal portion comprise tabs extending outward from the first part, and wherein the fasteners on the second part and second pedestal portion comprise receptacles configured and disposed to receive the tabs when the first part is attached to the second part.

* * * * *